US007874872B2

(12) United States Patent
Kaine

(10) Patent No.: US 7,874,872 B2
(45) Date of Patent: Jan. 25, 2011

(54) SUBMERSIBLE ELECTRICAL SET-SCREW CONNECTOR

(75) Inventor: Michel Kaine, Montreal (CA)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/481,791

(22) Filed: Jun. 10, 2009

(65) Prior Publication Data

US 2009/0311921 A1 Dec. 17, 2009

Related U.S. Application Data

(60) Provisional application No. 61/131,909, filed on Jun. 13, 2008.

(51) Int. Cl.
*H01R 13/40* (2006.01)

(52) U.S. Cl. ..... 439/587; 277/607; 277/626; 277/644

(58) Field of Classification Search ..... 439/523, 439/587, 793, 797, 798, 810, 932; 277/607, 277/609, 616, 626, 630, 644, 917
See application file for complete search history.

(56) References Cited

U.S. PATENT DOCUMENTS

| | | | | |
|---|---|---|---|---|
| 3,512,118 | A * | 5/1970 | Leonard | 439/281 |
| 3,827,704 | A | 8/1974 | Gillemot et al. | 277/209 |
| 4,259,542 | A | 3/1981 | Tehan et al. | 174/48 |
| 4,283,597 | A | 8/1981 | Cooper, Jr. | 174/138 |
| 4,460,227 | A | 7/1984 | Ball | 339/94 |
| 4,648,672 | A | 3/1987 | Kobler | 339/94 |
| 5,533,912 | A * | 7/1996 | Fillinger et al. | 439/521 |
| 6,764,354 | B2 | 7/2004 | Kaine et al. | 439/793 |
| 6,817,910 | B2 | 11/2004 | Borgstrom et al. | 439/798 |
| 6,997,759 | B1 | 2/2006 | Zahnen et al. | 439/798 |
| 7,090,532 | B1 | 8/2006 | Kaine | 439/523 |
| 7,094,094 | B2 * | 8/2006 | Zahnen et al. | 439/521 |
| 2006/0155280 | A1 | 7/2006 | Siebens et al. | 606/61 |
| 2008/0268721 | A1 | 10/2008 | Waltz | 439/793 |

OTHER PUBLICATIONS

"Mole Coupler and Mole Sleeve", Burndy ® Underground Products for Network and Residential Distribution Catalog, Apr. 2008, p. 35.

* cited by examiner

*Primary Examiner*—Tho D Ta
(74) *Attorney, Agent, or Firm*—Harrington & Smith

(57) ABSTRACT

Disclosed herein is an electrical connector sealing member. The electrical connector sealing member includes an outer surface and an inner channel. A portion of the outer surface includes a stepped outer diameter. The sealing member is adapted to be received by an electrical connector at the outer surface. A portion of the inner channel includes a stepped inner diameter. The sealing member is adapted to receive an electrical conductor at the inner channel. The stepped inner diameter is offset from the stepped outer diameter.

25 Claims, 7 Drawing Sheets

SUBMERSIBLE ELECTRICAL SET-SCREW CONNECTOR

CROSS REFERENCE TO RELATED APPLICATION

This application claims priority under 35 U.S.C. §119(e) to U.S. provisional patent application No. 61/131,909 filed Jun. 13, 2008 which is hereby incorporated by reference in its entirety.

BACKGROUND

1. Field of the Invention

The invention relates to an electrical connector and, more particularly, to an underground or submersible electrical set-screw connector.

2. Brief Description of Prior Developments

Submersible electrical set-screw connectors for making connections in power distribution networks are known in the art. U.S. Pat. No. 6,764,354 B2, which is hereby incorporated by reference in its entirety, discloses a submersible electrical set-screw connector. A similar insulated water-tight connector assembly including a set screw driver and plug is disclosed in U.S. Patent Publication No. 2006/0155280 A1 which is hereby incorporated by reference in its entirety. These conventional connectors provide set-screw assemblies having various configurations.

SUMMARY

The foregoing and other problems are overcome, and other advantages are realized, by the use of the exemplary embodiments of this invention.

In accordance with one aspect of the invention, an electrical connector sealing member is disclosed. The electrical connector sealing member includes an outer surface and an inner channel. A portion of the outer surface includes a stepped outer diameter. The sealing member is adapted to be received by an electrical connector at the outer surface. A portion of the inner channel includes a stepped inner diameter. The sealing member is adapted to receive an electrical conductor at the inner channel. The stepped inner diameter is offset from the stepped outer diameter.

In accordance with another aspect of the invention, a submersible electrical set-screw connector is disclosed. The submersible electrical set-screw connector includes a connector body section and a cover. The connector body section includes a first opening and a second opening. The first opening is substantially perpendicular to the second opening. The first opening is adapted to receive a portion of an electrical conductor. The cover is on the body section. The cover includes a tube having a tube opening. The tube opening is substantially aligned with the first opening of the connector body section. The tube opening includes a first section having a first inside diameter and a second section having a second inside diameter. The first inside diameter is offset from the second inside diameter.

In accordance with another aspect of the invention, a method of manufacturing an electrical connector sealing member is disclosed. A body section is provided having an outer surface. The outer surface includes a first outer diameter and a second different outer diameter. The body section is adapted to be received by an electrical connector at the outer surface. An inner channel extending through a majority of the body section is provided. At least a portion of the inner channel is offset from the outer surface. The inner channel includes a first inner diameter and a second different inner diameter. The inner channel is adapted to receive an electrical conductor.

BRIEF DESCRIPTION OF THE DRAWINGS

The foregoing aspects and other features of the invention are explained in the following description, taken in connection with the accompanying drawings, wherein.

DETAILED DESCRIPTION

Figure 1:
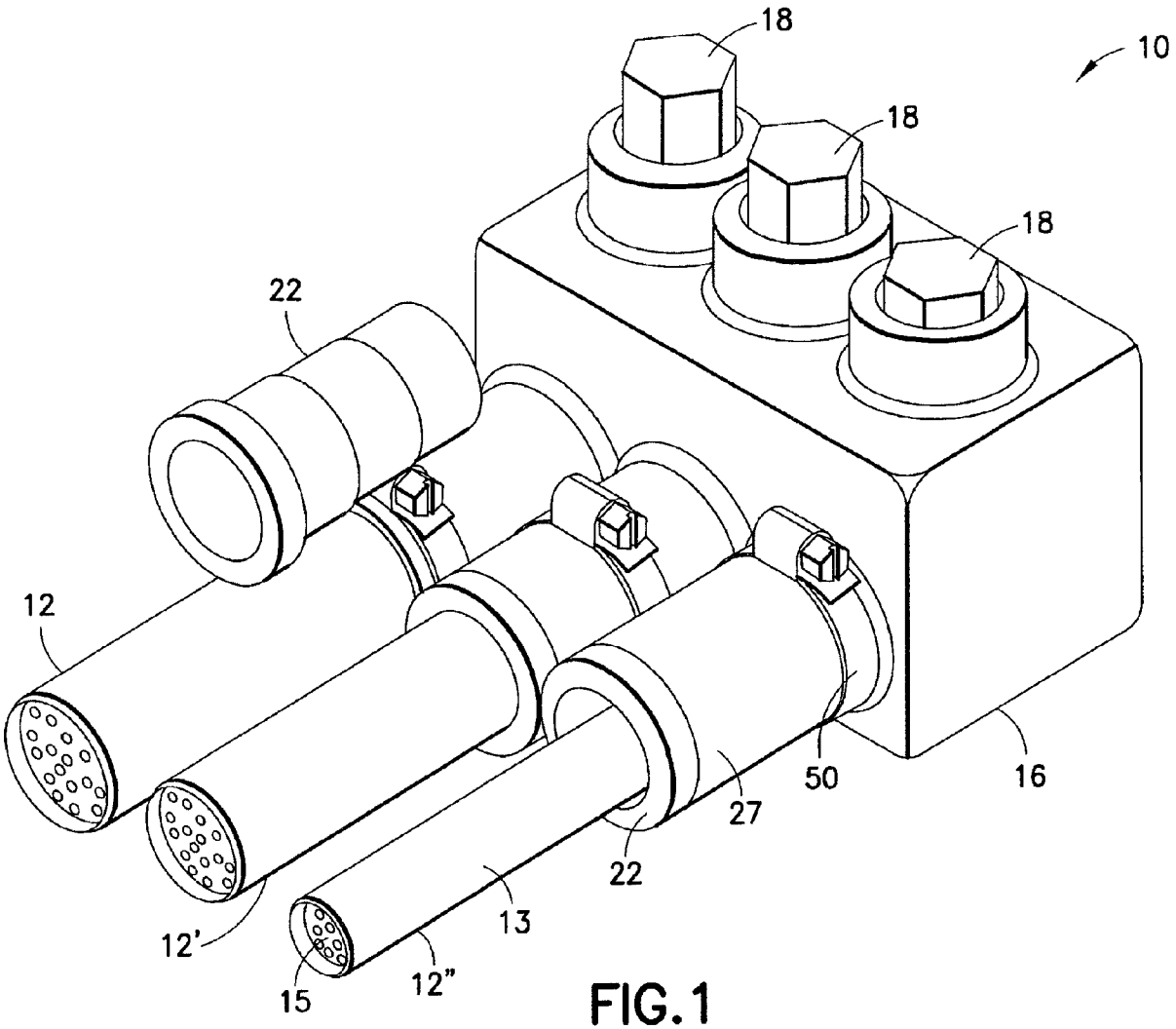
FIG. 1 is a perspective view of a submersible or underground electrical set-screw connector comprising features of the invention.
Figure 1A:
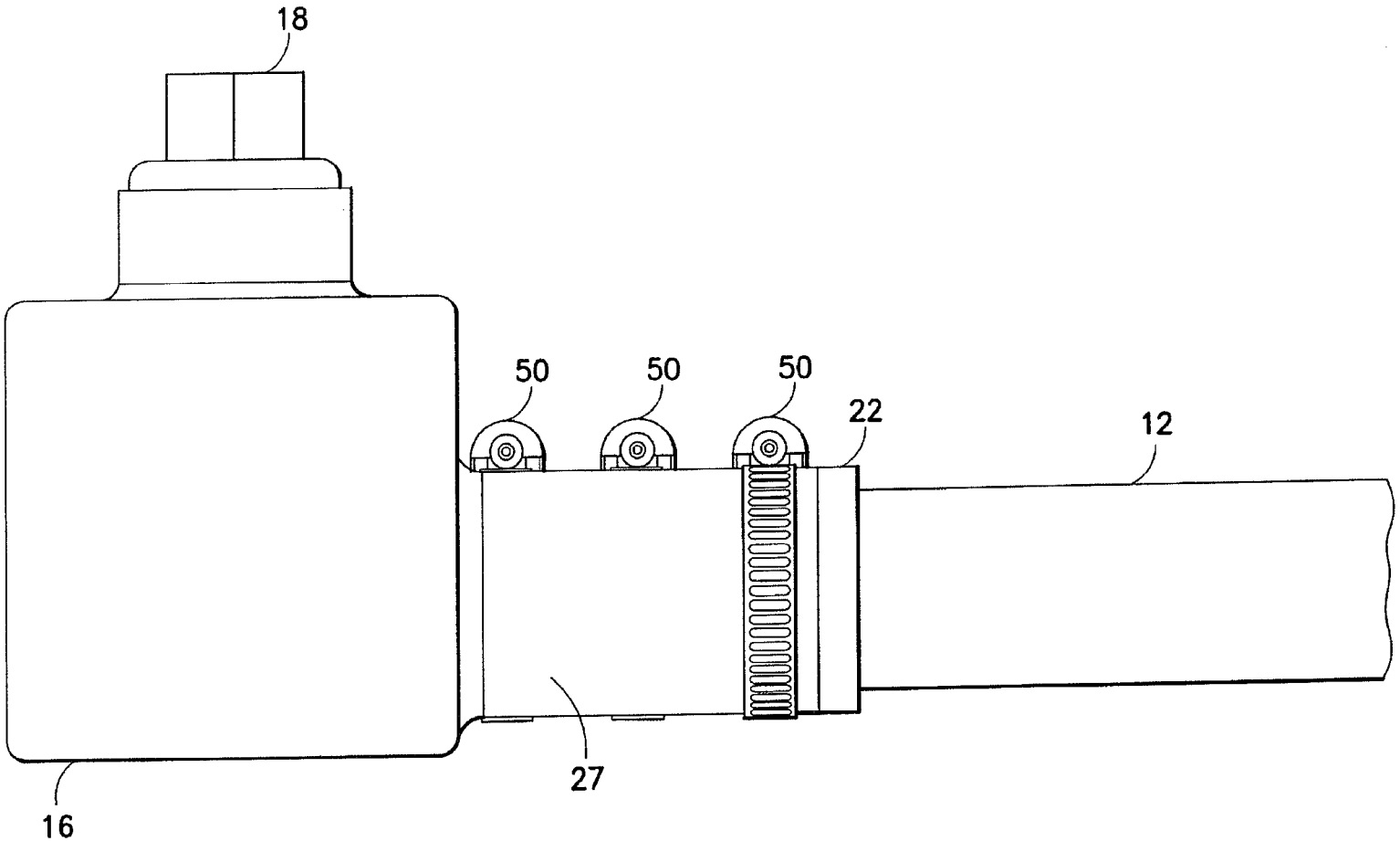
FIG. 1A is a side view of the connector shown in FIG. 1.
Figure 2:
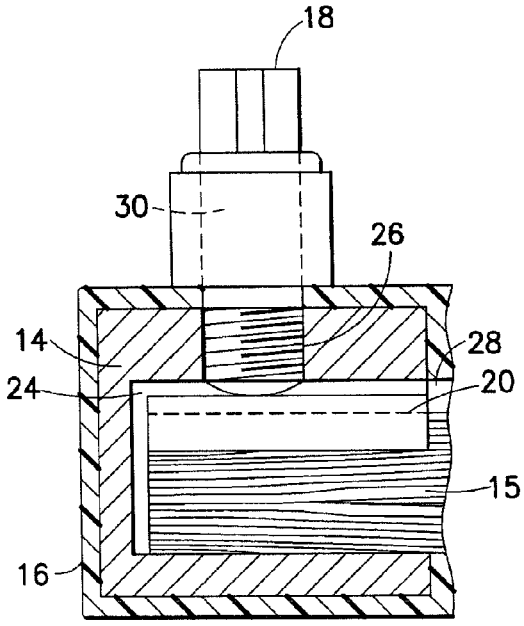
FIG. 2 is a cross sectional partial view of the submersible electrical set-screw connector shown in FIG. 1.
Figure 3:
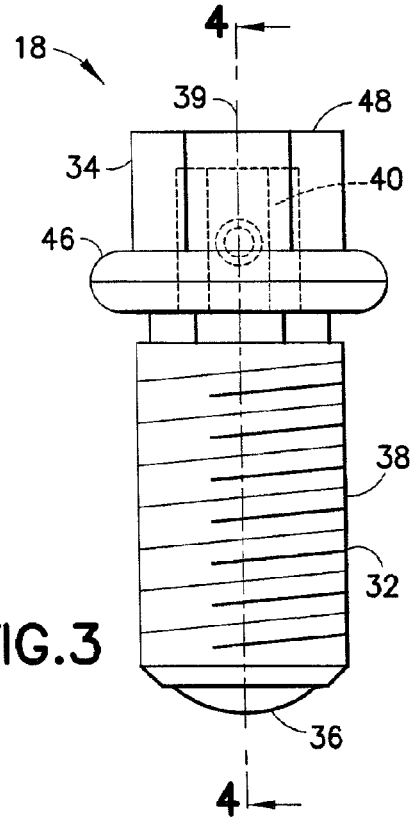
FIG. 3 is a front view of a set-screw assembly used in the submersible electrical set-screw connector shown in FIG. 1.
Figure 4:
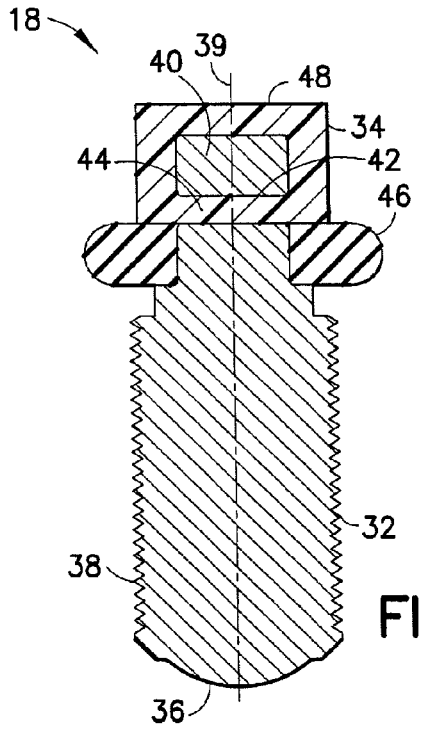
FIG. 4 is a cross section view of the set-screw assembly shown in FIG. 3.

Referring to FIG. 1, there is shown a perspective view of a submersible or underground electrical set-screw connector 10 incorporating features of the invention, intended to be used to connect multiple electrical conductors 12, 12', 12" to each other. FIG. 1 shows one of the sealing members 22 (for the largest conductor) in an exploded view. Although the invention will be described with reference to the exemplary embodiments shown in the drawings, it should be understood that the invention can be embodied in many alternate forms of embodiments. In addition, any suitable size, shape or type of elements or materials could be used. For example, in this embodiment the connector is adapted to connect three conductors to each other. However, in alternate embodiments the connector could be adapted to connector more or less than three conductors.

Referring also to FIGS. 1A and 2-4, the connector 10 generally comprises a body 14, a cover 16, set screw assemblies 18, adapters 20, and sealing members 22. In an alternate embodiment the adapters 20 might not be provided. The connector might also include sealing plugs (not shown) to cover unused holes in the cover 16. The body, or connector body section, 14 is comprised of electrically conductive material, such as aluminum for example. The body 14 has holes (or openings) 24 for receiving the electrically conductive cores 15 of the conductors 12. The body 14 also has holes (or openings) 26 for receiving the set screw assemblies 18.

Figure 5:
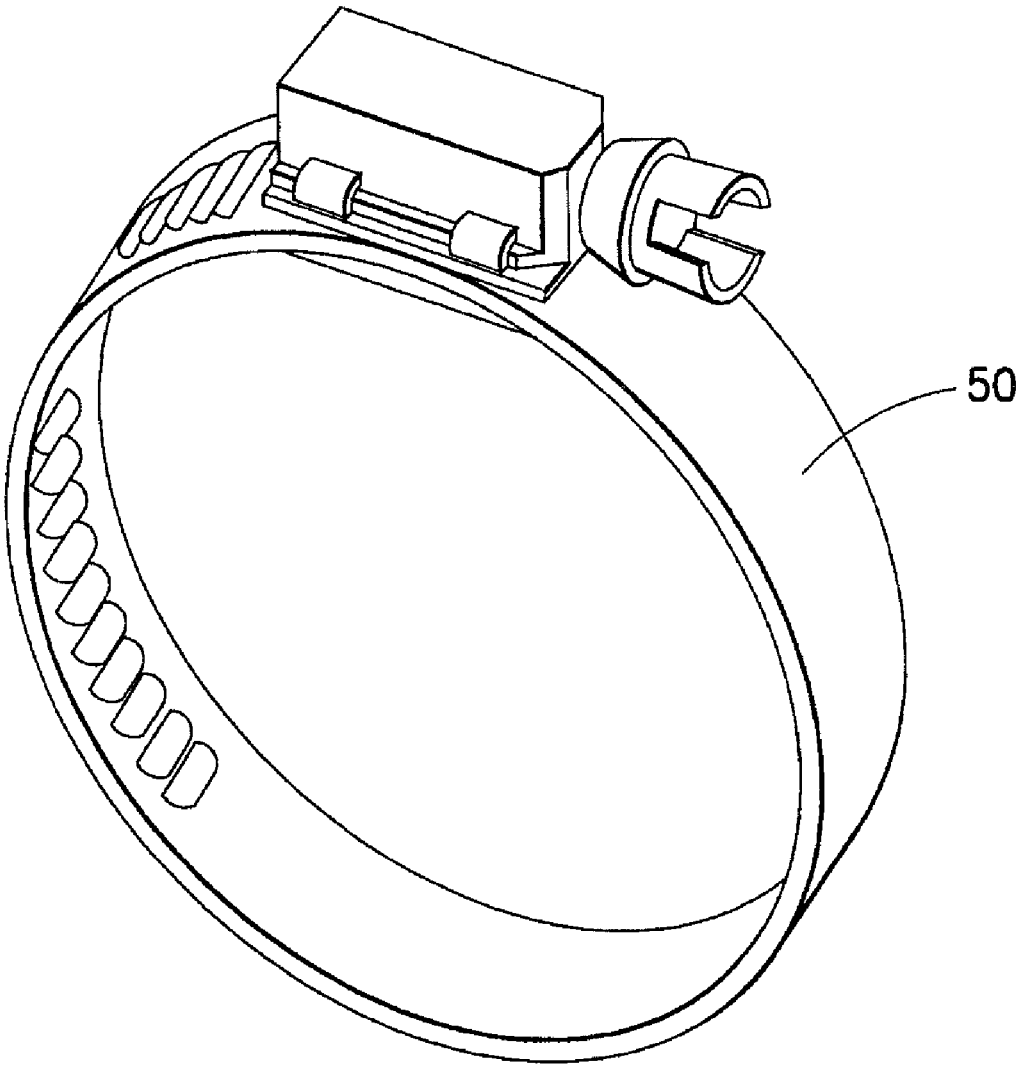
FIG. 5 is a perspective view of a clamp for use with the connector shown in FIG. 1.
Figure 8:
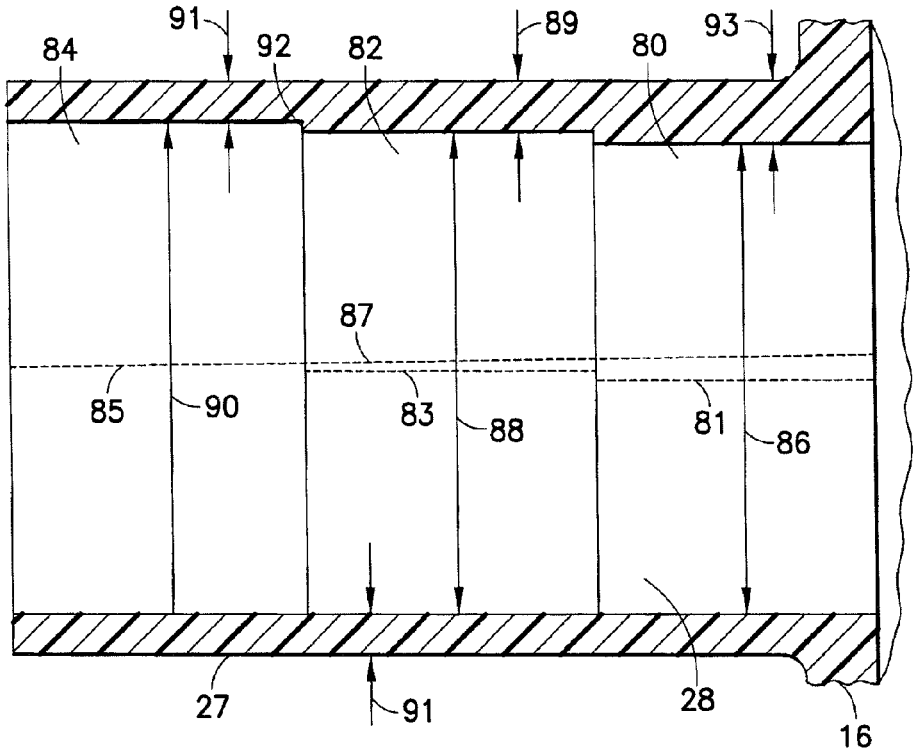
FIG. 8 is a cross sectional view of a tube of the cover of the connector shown in FIG. 1.

The holes 24 are substantially perpendicular to the holes 26. However, alternate embodiments may comprise any suitable configuration. The cover 16 is preferably overmolded onto the body 14. The cover is comprised of an electrically insulating material such as a polymer material. Referring also to FIG. 8, the cover 16 has tubes 27 with holes (or openings) 28 for receiving ends of the conductors 12 and the sealing members 22. The sealing members 22 may be removably connected to the connector 10 at the holes 28. Referring also to FIG. 5, each tube 27 preferably has a clamp 50 on it to clamp the tube 27 and the sealing member 22 onto the outer diameter of the conductor 12. The cover 16 also has holes (or openings) 30 for receiving the set screw assemblies 18. The holes 28 are substantially perpendicular to the holes 30. However, alternate embodiments may comprise any suitable configuration.

Each of the set screw assemblies 18 generally comprise a screw body 32 and a screw head 34. Similar set screw assemblies are described in U.S. patent application Ser. No. 12/103,200 filed Apr. 15, 2008 which is hereby incorporated by reference in its entirety. The screw body, or body part, 32 is preferably comprised of metal and comprises a first end 36 for contacting the conductor 12 or the adapter 20, a threaded shaft (or threaded section) 38 and a second end 40. The second end 40 has a general hexagon shape with a channel 42 therein. The channel 42 extends in a direction substantially transverse to a central axis 39 of the threaded section 38.

The screw head 34 is preferably comprised of an electrically insulating material, such as a molded plastic or polymer material. The screw head 34 is preferably overmolded onto the second end 40 of the screw body 32. During overmolding, material forming the screw head 34 extends into the channel 42 to form locking section 44 and surrounds a portion of an outer surface of the second end 40. This interlocks the screw head 34 onto the screw body 32 as a non-removable connection forms the screw body 32 and the screw head 34 into a one-piece member. In an alternate embodiment the connection might be removable, such as if the screw head is connected to the screw body after the screw head is formed.

The screw head, or head part, 34 generally comprises the locking section 44 located in the channel 42 and a top hexagon section 48. A separate or integrally formed sealing ring section 46 is provided. The locking section 44 is integrally formed with the screw head 34 during the overmolding. The top hexagon section 48 is aligned with the hexagon shape of the second end 40 of the screw body 32 such that the material of the screw head 34 at the top hexagon section 48 has a substantially uniform thickness. During overmolding, the screw body 32 is precisely located in one of six positions in the molding device to align the hexagon shapes. The uniform thickness of the material at the top hexagon section 48 provides the benefit of better strength of the section 48 and helps to prevent cracks from developing. The hexagon shape is provided for a hexagon shaped tool or a wrench to screw the set screw assembly 18 into the body 14 and cover 16. In alternate embodiments, other shapes could be provided.

When the set screw assembly 18 is inserted into one of the holes 30, 26, the threaded shaft 38 can thread into the threaded hole 26. The sealing ring section 46 can make a sealing engagement with the cover 16 at the hole 30.

While the submersible electrical set-screw connector 10 has been described in connection with the set screw assembly 18, one skilled in the art will appreciate that the invention is not necessarily so limited and that any suitable set screw assembly may be provided.

Figure 6:
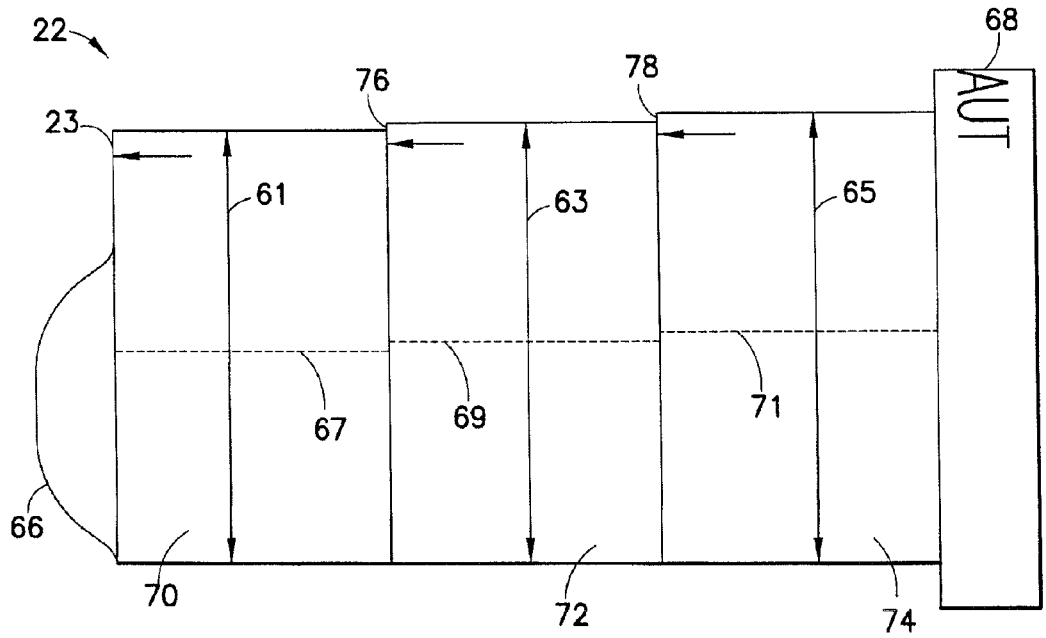
FIG. 6 is a side view of a sealing member for use with the connector shown in FIG. 1.
Figure 7:
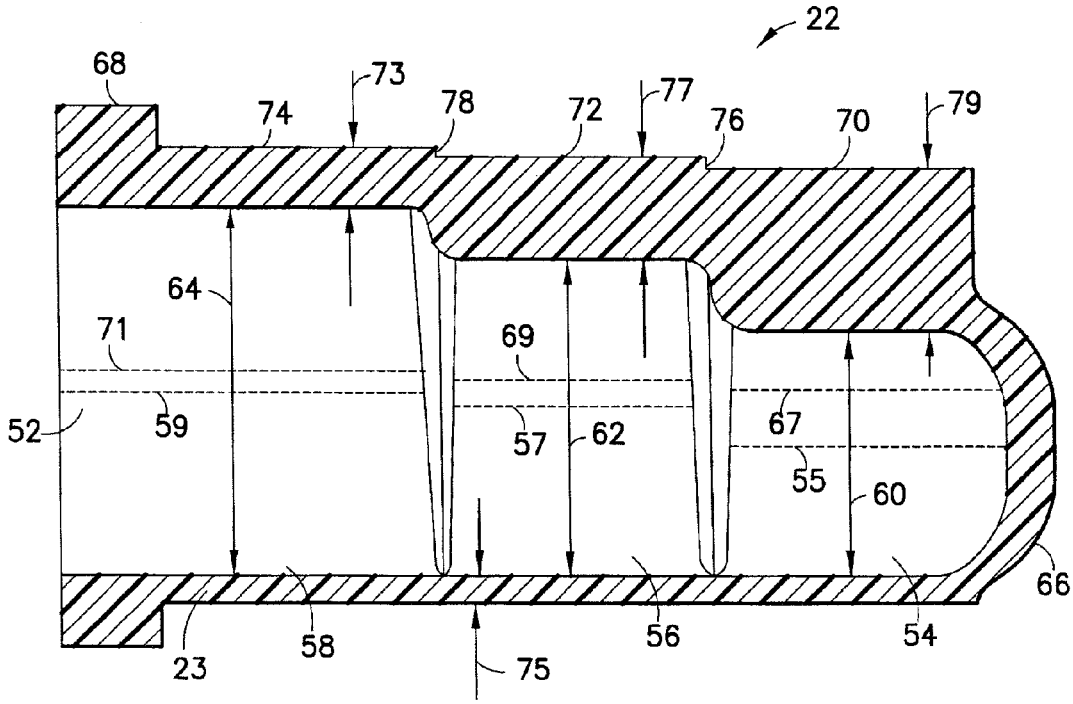
FIG. 7 is a cross sectional view of the sealing member shown in FIG. 6.

Referring also to FIGS. 6 and 7, in a preferred embodiment of the invention each of the sealing members 22 can be configured or modified for use with any one of a plurality of different size conductors 12, 12', 12" as shown in FIG. 1. The sealing member 22 is preferably comprised of molded resilient polymer material. In an alternate embodiment, the sealing member may comprise a one piece member formed from an elastomer material. However, any suitable configuration or material may be provided. The sealing member 22 comprises a body section 23 having an inner channel 52. The inner channel 52 has three sections 54, 56, 58 with different size diameters 60, 62, 64. The different size diameters 60, 62, 64 form a stepped inner diameter for the inner channel 52. The smallest diameter 60 is in the front and the largest diameter 64 is in the rear. All the diameters have a bottom end at the same location. This provides for each of the sections 54, 56, 58 (and corresponding diameters 60, 62, 62) to have centerline axis 55, 57, 59 which are offset from each other. In alternate embodiments more or less than three sections with different size diameters could be provided. In addition, the bottom ends might not be at the same location. The front has a cap section 66, but this might be open. The rear has a flange 68, but this might not be provided.

The outer surface of the sealing member 22 (besides the cap 66 and flange 68) has three sections 70, 72, 74 with different size diameters 61, 63, 65. The different size diameters 61, 63, 65 form a stepped outer diameter for the outer surface of the sealing member 22. The three sections 70, 72, 74 generally correspond or align to the three sections 54, 56, 58. The smallest diameter 61 is in the front and the largest diameter 65 is in the rear in front of the flange 68. All the diameters 61, 63, 65 have a bottom end at the same location. This provides for each of the sections 70, 72, 74 (and the corresponding diameters 61, 63, 65) to have centerline axis 67, 69, 71 which are offset from each other. Additionally, the centerline axis 55, 57, 59 of the three sections 54, 56, 58 are offset from the centerline axis 67, 69, 71 of the three sections 70, 72, 74. In alternate embodiments more or less than three sections with different size diameters could be provided. In addition, the bottom ends might not be at the same location. Steps 76, 78 at the top of the sealing member 22 clearly distinguish where the different sections 70, 72, 74 are; and thus where the different sections 54, 56, 58 are.

Any suitable outer diameters and inner diameters may be provided for the sealing members. For example, the diameter 65 of the section 74 may be about twenty percent larger than the diameter 64 of the section 58. The diameter 63 of the section 72 may be about thirty percent larger than the diameter 62 of the section 56. The diameter 61 of the section 70 may be about seventy-five percent larger than the diameter 60 of the section 54. Additionally, due to the offset configuration of the outer diameters and the inner diameters, various different wall thicknesses may be provided between the inner diameters and the outer diameters. For example, the wall thickness 73 may be about two times larger (or thicker) than the wall thickness 75. The wall thickness 77 may be about four times larger (or thicker) than the wall thickness 75. The wall thickness 79 may be about six times larger (or thicker) than the wall thickness 75. However, any suitable wall thickness configuration may be provided.

As seen in FIG. 8, the hole 28 in each tube 27 has three sections 80, 82, 84 having different inner diameters 86, 88, 90 and a substantially constant outer diameter. The diameters 86, 88, 90 generally correspond to the diameters of the sections 70, 72, 74. In this embodiment, centerline axis 81, 83, 85 of the sections 80, 82, 84 (and the diameters 86, 88, 90) are offset from each other. Additionally, the centerline axis 81, 83 of the sections 80, 82 may be offset from a centerline axis 87 of the tube 27, while the centerline axis 85 of the section 84 may be substantially aligned with centerline 87. However, any suitable configuration may be provided.

Due to the offset nature of the sections 80, 82, various different wall thicknesses may be provided at the tube. For example, wall thickness 89 may be greater than wall thickness 91, and wall thickness 93 may be greater than wall thickness 91. However, any suitable configuration may be provided.

Figure 9:
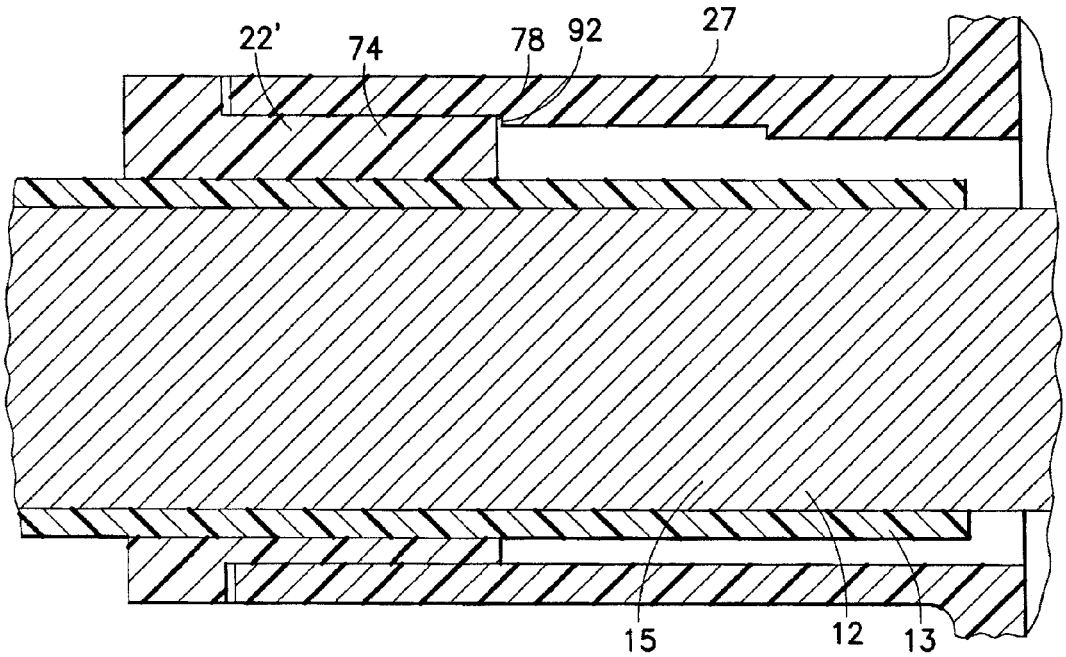
FIG. 9 is a cross sectional view of a first electrical conductor, the tube shown in FIG. 7, and the sealing member shown in FIG. 6.

Referring now also to FIG. 9, the first conductor 12 is shown inside the tube 27 with the sealing member having been cut to form the modified sealing member 22'. The sealing member 22 was cut proximate the step 78 to remove the first two sections 70, 72. The inner diameter 64 of the third section 74 is sized to make a snug fit with the insulation 13 of the conductor 12. The step 78 is able to engage the step 92 in the tube 27.

Figure 10:
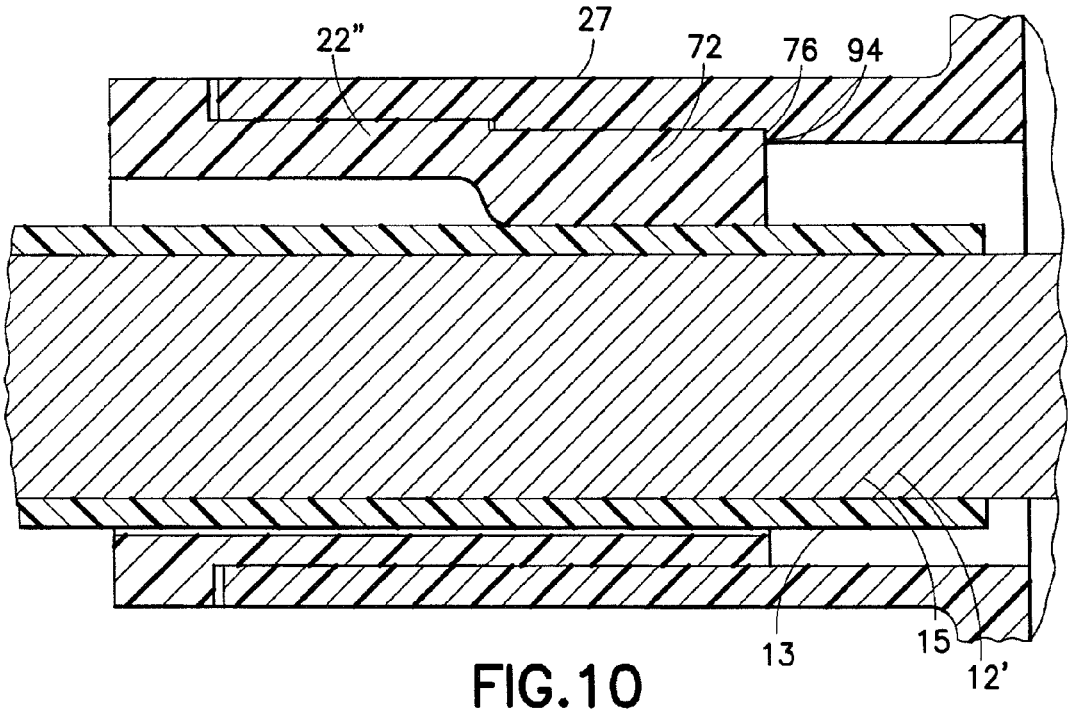
FIG. 10 is a cross sectional view of a second electrical conductor, the tube shown in FIG. 7, and the sealing member shown in FIG. 6 cut for the size of the second electrical conductor.

Referring now also to FIG. 10, the second conductor 12' is shown inside the tube 27 with the sealing member having been cut to form the modified sealing member 22". The second conductor 12' has a smaller diameter than the first conductor 12. The sealing member 22 was cut proximate the step 76 to remove the first section 70. The inner diameter 62 of the second section 72 is sized to make a snug fit with the insulation 13 of the conductor 12'. The step 76 is able to engage the step 94 in the tube 27.

Figure 11:
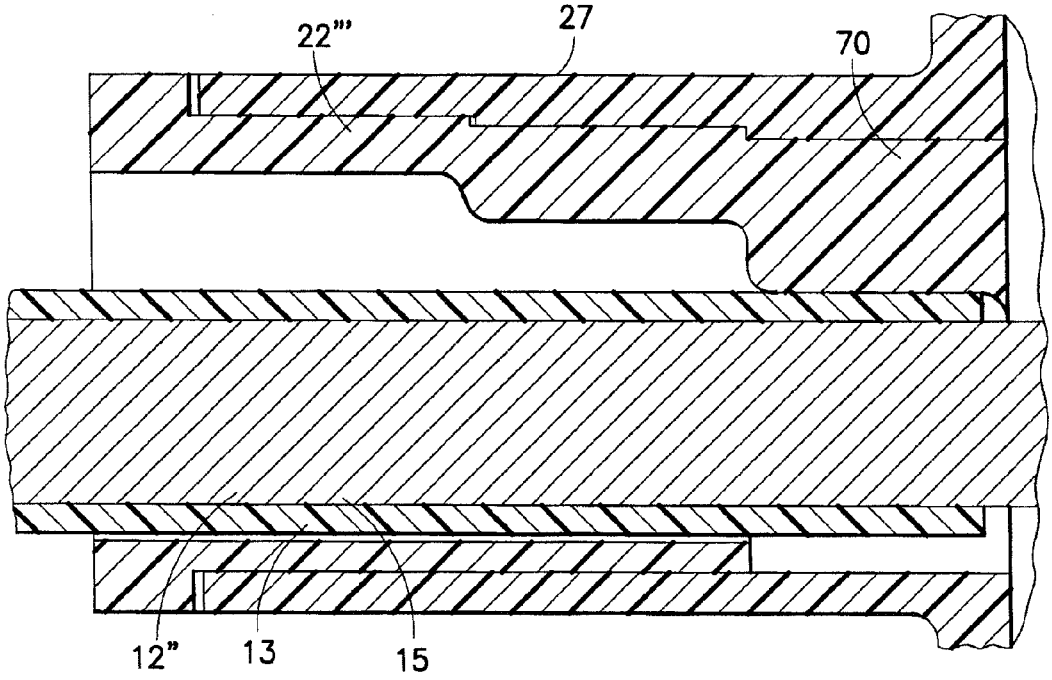
FIG. 11 is a cross sectional view of a third electrical conductor, the tube shown in FIG. 7, and the sealing member shown in FIG. 6 cut for the size of the third electrical conductor.

Referring now also to FIG. 11, the third conductor 12" is shown inside the tube 27 with the sealing member having been cut to form the modified sealing member 22'''. The third conductor 12' has a diameter smaller than the diameter of the second conductor 12'. The sealing member 22 was cut merely to remove the cap 66. The inner diameter 60 of the first section 70 is sized to make a snug fit with the insulation 13 of the third conductor 12".

The connector 10 can preferably be placed on the ground with the conductors 12, 12', 12" also lying on the ground as they enter the connector 10. The offset nature of the diameters 60, 62, 64 allow the diameters 60, 62, 64 to be located close to the bottom of the connector for the purpose of allowing the conductors 12, 12', 12" to lay close to the ground as they enter the connector 10.

The connector 10 can also comprise different size adapters 20 for the different size conductors 12, 12', 12". However, in alternate embodiments more or less than three size adapters could be provided, or the connector might not have any adapters, such as if the set screw assemblies 18 are long enough for example.

When the clamps 50 are tightened around the outer perimeter of respective ones of the tubes 27, the tubes 27 compress the sealing members 20', 22", 22''' onto the outer insulation 13 of the conductors 12, 12', 12" to form a watertight seal with the conductors in the holes 28. The sealing members 22', 22", 22''' form removable bushings which can be provided as a kit for the installer/user to configure as he/she sees fit in view of the sizes of the conductors being connected together by the connector 10.

The invention can provide a cable seal member or rocket with a step-tapered inside diameter to provide for different cable outside diameters. The seal would be cut by the installer to best fit the outside diameter of the cable being used. The inside diameters are offset from center in order to keep the cable conductors aligned with the bottom of the cable port in the aluminum block 14.

In one embodiment of the cable seal, the outside diameter is not tapered similar to the inside diameter. Rather, it is sized to match the inside diameter of the connector's cable entry port into the cover. This now provides a more solid material construction (i.e.—no air gaps around the cable seal when it is installed into the connector port). A hose clamp is then installed around the outside of each connector silo. The clamp compresses the silo, seal and cable surfaces together to provide a water tight connection.

According to one example of the invention, a method of manufacturing an electrical connector sealing member is disclosed. The method includes the following steps. Providing a body section having an outer surface, wherein the outer surface comprises a first outer diameter and a second different outer diameter, and wherein the body section is adapted to be received by an electrical connector at the outer surface. Providing an inner channel extending through a majority of the body section, wherein at least a portion of the inner channel is offset from the outer surface, wherein the inner channel comprises a first inner diameter and a second different inner diameter, and wherein the inner channel is adapted to receive an electrical conductor. It should be noted that any of the above steps may be performed alone or in combination with one or more of the steps.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector sealing member comprising an outer surface and an inner channel, wherein a portion of the outer surface comprises a stepped outer diameter, wherein the sealing member is adapted to be received by an electrical connector at the outer surface, wherein a portion of the inner channel comprises a stepped inner diameter, wherein the sealing member is adapted to receive an electrical conductor at the inner channel, and wherein a centerline axis of the stepped inner diameter is offset from a centerline axis of the stepped outer diameter.

2. An electrical connector sealing member as in claim 1 wherein the sealing member comprises a one piece member formed from a polymer material.

3. An electrical connector sealing member as in claim 1 wherein the outer surface comprises a first outer section and a second outer section, wherein the first outer section comprises a first outer diameter, and wherein the second outer section comprises a second different outer diameter.

4. An electrical connector sealing member as in claim 1 wherein the inner channel comprises a first inner section and a second inner section, wherein the first inner section comprises a first inner diameter, and wherein the second inner section comprises a second different inner diameter.

5. An electrical connector sealing member as in claim 1 wherein the sealing member comprises a one piece member formed from a polymer material, wherein the outer surface comprises a first outer section and a second outer section, wherein the first outer section comprises a first outer diameter, and wherein the second outer section comprises a second different outer diameter.

6. An electrical connector sealing member as in claim 5 wherein the inner channel comprises a first inner section and a second inner section, wherein the first inner section comprises a first inner diameter, and wherein the second inner section comprises a second different inner diameter.

7. An electrical connector sealing member as in claim 6 wherein the first inner section corresponds with the first outer section, wherein the second inner section corresponds with the second outer section, wherein a centerline axis of the first inner diameter is offset from a centerline axis of the first outer diameter, and wherein a centerline axis of the second inner diameter is offset from a centerline axis of the second outer diameter.

8. An electrical connector sealing member as in claim 1 wherein the outer surface comprises a first outer section, a second outer section, and a step between the first and second outer sections, and wherein the sealing member is adapted to be cut proximate the step.

9. An electrical connector sealing member as in claim 8 wherein the outer surface further comprises a third outer section and another step, wherein the another step is between the second outer section and the third outer section, and wherein the sealing member is adapted to be cut proximate the another step.

10. An electrical connector sealing member as in claim 1 wherein the stepped outer diameter comprises at least three different outer diameters.

11. An electrical connector sealing member as in claim 10 wherein the stepped inner diameter comprises at least three different inner diameters.

12. An electrical connector sealing member as in claim 11 wherein the at least three different inner diameters correspond with and are offset from the at least three different outer diameters.

13. An electrical connector sealing member as in claim 1 wherein one end of the sealing member comprises a flange and wherein an opposite end comprises a cap section.

14. A submersible electrical set-screw connector comprising:

a connector body section comprising a first opening and a second opening, wherein the first opening is substantially perpendicular to the second opening, and wherein the first opening is adapted to receive a portion of an electrical conductor; and an electrical connector sealing member as in claim 1 removably connected to the submersible electrical set-screw connector.

15. A submersible electrical set-screw connector comprising:

a connector body section comprising a first opening and a second opening, wherein the first opening is substantially perpendicular to the second opening, and wherein the first opening is adapted to receive a portion of an electrical conductor; and a cover on the body section, wherein the cover comprises a tube having a tube opening, wherein the tube opening is substantially aligned with the first opening of the connector body section, wherein the tube opening comprises a first section having a first inside diameter and a second section having a second inside diameter, wherein the first inside diameter is offset from the second inside diameter, wherein the first inside diameter is adapted to contact a portion of a sealing member received in the tube opening, and wherein the second inside diameter is adapted to contact another different portion of the sealing member.

16. A submersible electrical set-screw connector as in claim 15 further comprising a first step between the first section and the second section, and wherein the first step is adapted to contact a portion of a sealing member received in the tube opening.

17. A submersible electrical set-screw connector as in claim 16 further comprising a third section and a second step, wherein the second step is between the second section and the third section, and wherein the second step is adapted to contact another portion of the sealing member received in the tube opening.

18. A submersible electrical set-screw connector as in claim 15 further comprising a sealing member removably connected to the connector at the tube opening.

19. A submersible electrical set-screw connector as in claim 18 wherein the sealing member comprises a first outer section and a second outer section, and wherein diameters of the first and the second outer sections correspond with the first and the second inside diameters of the tube opening.

20. A submersible electrical set-screw connector as in claim 18 wherein the sealing member comprises a stepped outer diameter and a stepped inner diameter.

21. A submersible electrical set-screw connector as in claim 18 wherein the sealing member comprises a first inner diameter and a second different inner diameter, wherein the first inner diameter is adapted to receive a first size conductor, and wherein the second inner diameter is adapted to receive a second different size conductor.

22. A submersible electrical set-screw connector as in claim 18 further comprising a clamp on the tube, wherein the clamp is adapted to compress the sealing member on to the conductor.

23. A method of manufacturing an electrical connector sealing member comprising:

providing a body section having an outer surface, wherein the outer surface comprises a first outer diameter and a second different outer diameter, wherein the body section is adapted to be received by an electrical connector at the outer surface, and wherein the first and the second outer diameters are adapted to correspond with first and second inner diameters of the electrical connector; and providing an inner channel extending through a majority of the body section, wherein at least a portion of the inner channel is offset from the outer surface, wherein the inner channel comprises a first inner diameter and a second different inner diameter, and wherein the inner channel is adapted to receive an electrical conductor.

24. A method as in claim 23 wherein the providing of the body section further comprises providing a first section, a second section, and a step, wherein the first section comprises the first outer diameter, wherein the second section comprises the second outer diameter, wherein the step is between the first section and the second section, and wherein sealing member is adapted to be cut proximate the step.

25. A method as in claim 24 wherein the providing of the body section further comprises providing a third section and another step, wherein the third section comprises a third outer diameter, wherein the another step is between the second section and the third section, and wherein sealing member is adapted to be cut proximate the another step.

* * * * *